US006163664A

United States Patent [19]

Hayashi

[11] Patent Number: 6,163,664

[45] **Date of Patent: *Dec. 19, 2000**

[54] SYSTEM FOR CLEANING DISCHARGING WIRES IN AN IMAGE FORMING APPARATUS

[75] Inventor: Nobuhiro Hayashi, Tokyo, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/255,865

[22] Filed: Feb. 23, 1999

[30] Foreign Application Priority Data

Feb. 25, 1998 [JP] Japan ..... 10-043331

[51] Int. Cl.[7] ..... G03G 15/02

[52] U.S. Cl. ..... 399/100

[58] Field of Search ..... 399/100, 168, 399/170, 171, 172, 310, 311

[56] References Cited

U.S. PATENT DOCUMENTS 4,731,633 3/1988 Foley et al. .

5,392,099 2/1995 Kusumoto et al. ..... 399/221

FOREIGN PATENT DOCUMENTS 31 16421 11/1982 Germany .

4-37874 2/1992 Japan .

4-86766 3/1992 Japan .

*Primary Examiner*—Arthur T. Grimley

*Assistant Examiner*—Hoang Ngo

*Attorney, Agent, or Firm*—Fitzpatrick, Cella, Harper & Scinto

[57] ABSTRACT

An image forming apparatus includes an image bearing member, discharging wires for discharging electricity to the image bearing member, a frictionally sliding device for reciprocating while frictionally sliding along the discharging wires, and a switch for changing the numbers of reciprocation of the frictionally sliding devices. With the apparatus, it is made possible for the apparatus to perform discharges uniformly from the very beginning when the discharge wires are used, and also, to perform image formation without unevenness due to the stains that may adhere to the wires by the repeated use thereof.

10 Claims, 4 Drawing Sheets

FIG. 5

| KIND OF WIRE / THE NUMBER OF USED SHEETS / CLEANING METHOD | PARTIALLY OXIDIZED TUNGSTEN WIRE | | GOLD-PLATED WIRE | | OXIDIZED TUNGSTEN WIRE | |
|---|---|---|---|---|---|---|
| | AFTER WIRE EXCHANGE | AFTER 100,000 SHEETS | AFTER WIRE EXCHANGE | AFTER 100,000 SHEETS | AFTER WIRE EXCHANGE | AFTER 100,000 SHEETS |
| PAD HAVING WEAK POLISHING FORCE IN PRIOR ART | × | × | ○ | × | ○ | × |
| PAD HAVING STRONG POLISHING FORCE IN PRIOR ART | × | ○ | × | ○ | × | ○ |
| EMBODIMENT OF PRESENT INVENTION | ○ | ○ | ○ | ○ | ○ | ○ |

SYSTEM FOR CLEANING DISCHARGING WIRES IN AN IMAGE FORMING APPARATUS

BACKGROUND OF THE INVENTION

1. Field of the Invention

The present invention relates to an image forming apparatus, such as a copying machine and a printer. More particularly, the invention relates to an image forming apparatus provided with discharge wires.

2. Related Background Art

Conventionally, for the image forming apparatus, such as an electronically photographic copying machine, which is provided with charging means using charging wires, it has been generally practiced to arrange cleaning means for removing stains caused by the repeated used of the charging wires. The cleaning means is structured in such a manner that each of the cleaning pads or the like is allowed to slide on the tensioned charging wire so that the stains adhering to the charging wire are removed by the periodic operation of cleaning means.

As the charging wire, a tungsten wire is used. There are also used a gold-plated wire which is the tungsten wire plated with gold on its surface, and an oxidized tungsten wire which is the tungsten wire processed by oxidation.

Also, as the cleaning pads, there are used various ones in the range from the pad having an abrasive force weak enough so as not to peel off the gold plate to the pads having the reinforced abrasive force in combination with the tungsten wire.

However, with the adoption of the conventional art, the following drawbacks are encountered: At first, for use of the gold-plated wire, it is usually practiced to adopt its combination with pads having the weaker abrasive force so as not to cause the gold plate to be peeled off. Therefore, although it is possible to execute charging uniformly without any unevenness in the earlier stage following the replacement of such pads, the uneven images are produced eventually when stains are caused by the repeated use of the charging wires, because the pads having the weaker abrasive force cannot remove stains sufficiently.

Then, when the tungsten wires, and the pads each having a strong abrasive force are combined, the stains that may take place by the repeated use of the charging wires can be removed by the application of such strong abrasive force of each pad. However, since the tungsten wires tend to be naturally oxidized, the uneven images are formed after all in the earlier stage after the pads have been replaced if the tungsten wires which have been naturally oxidized should be used. Further, with the usual abrasion, the oxidized portions of the wires cannot be removed, and it is made impossible to recover such image unevenness. Here, however, after discharging is continued by the repeated use, the wires are oxidized entirely, then, it becomes possible to recover the image unevenness gradually.

Also, when the oxidized tungsten wires and the pads having strong abrasion force are combined for use, the stains that take place by the repeated use of the charging wire can be removed by such abrasive force of each pad, and no image unevenness may result unless cleaning is conducted in the earlier stage after the pads have been replaced. Nevertheless, if the wire cleaning is once conducted, the oxidized film is peeled off, and the film thus peeled off may adhere to the wire to cause uneven discharging, which results in the image unevenness after all.

SUMMARY OF THE INVENTION

It is an object of the invention to provide an image forming apparatus capable of performing its discharges evenly from the beginning when the discharging wires are used.

It is another object of the invention to provide an image forming apparatus capable of maintaining its discharges evenly for a long time.

It is still another object of the invention to provide an image forming apparatus capable of using the tungsten wire whose surface is processed by oxidation.

It is a further object of the invention an image forming apparatus which comprises an image bearing member (carrier), discharging wires that discharge electricity to the image carrier; frictionally sliding (slidably abrading) means that slidably reciprocates while abrading the discharging wires; and switching means to change the numbers of reciprocation of the slidably abrading means.

Other objectives of the invention will be apparent from the following description of a preferred embodiment of the invention.

BRIEF DESCRIPTION OF THE DRAWINGS

FIG. 5 is a table which shows the results of experiments.

DETAILED DESCRIPTION OF THE PREFERRED EMBODIMENTS

Hereinafter, in conjunction with the accompanying drawings, the description will be made of the embodiments in accordance with the present invention.

(First Embodiment)

Figure 1:
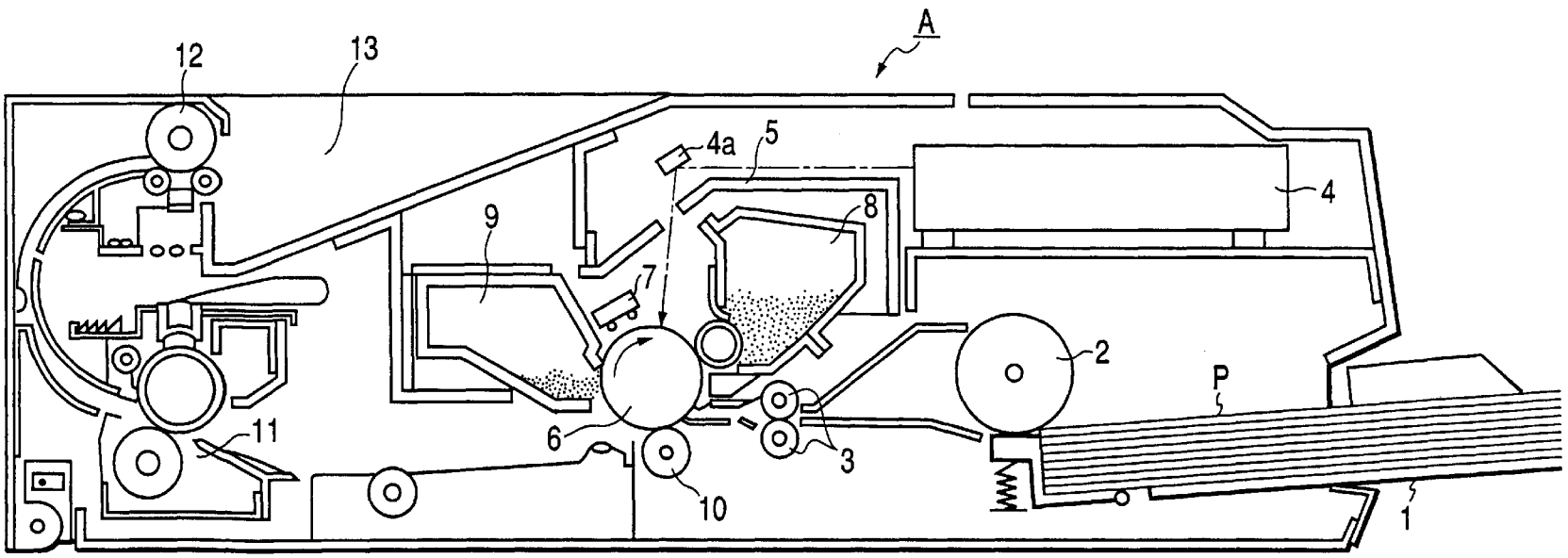
FIG. 1 is a view which shows the entire structure of an image forming apparatus in accordance with a first embodiment of the present invention.
Figure 2:
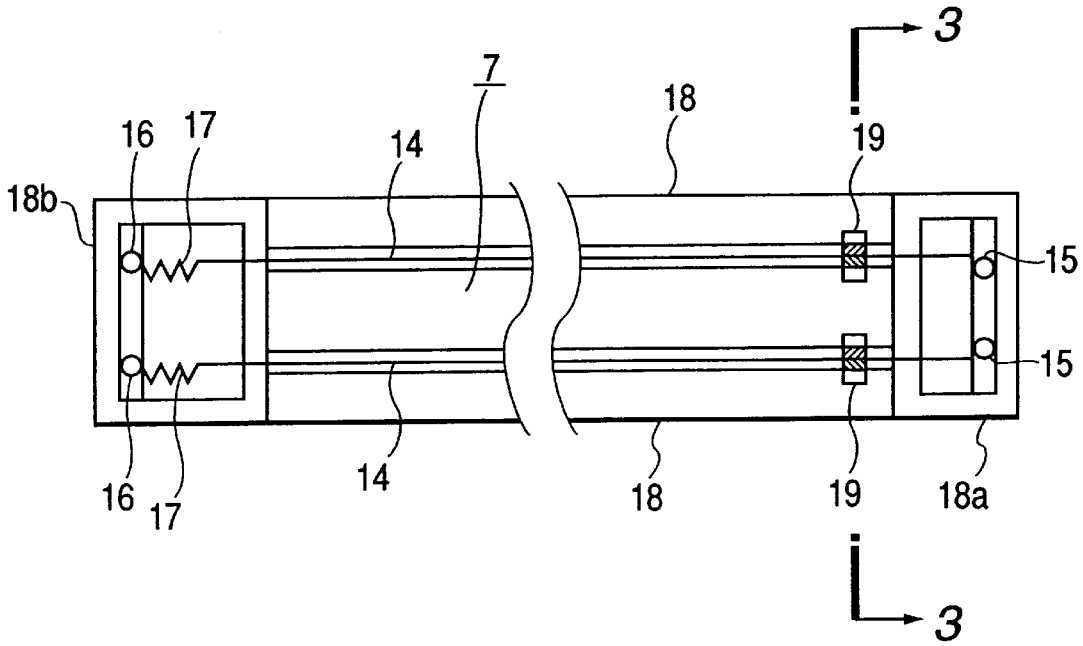
FIG. 2 is a plan view which shows the charging means to which the present invention is applicable.
Figure 3:
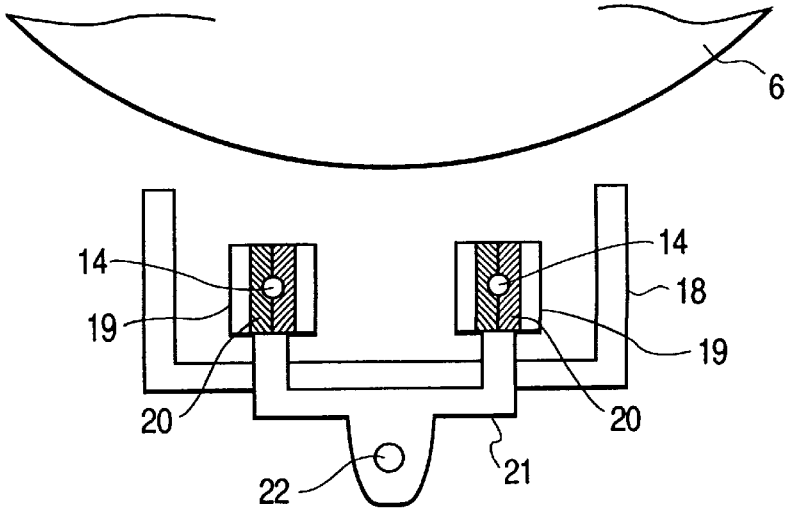
FIG. 3 is a cross-sectional view taken along line 3—3 in FIG. 2.
Figure 4:
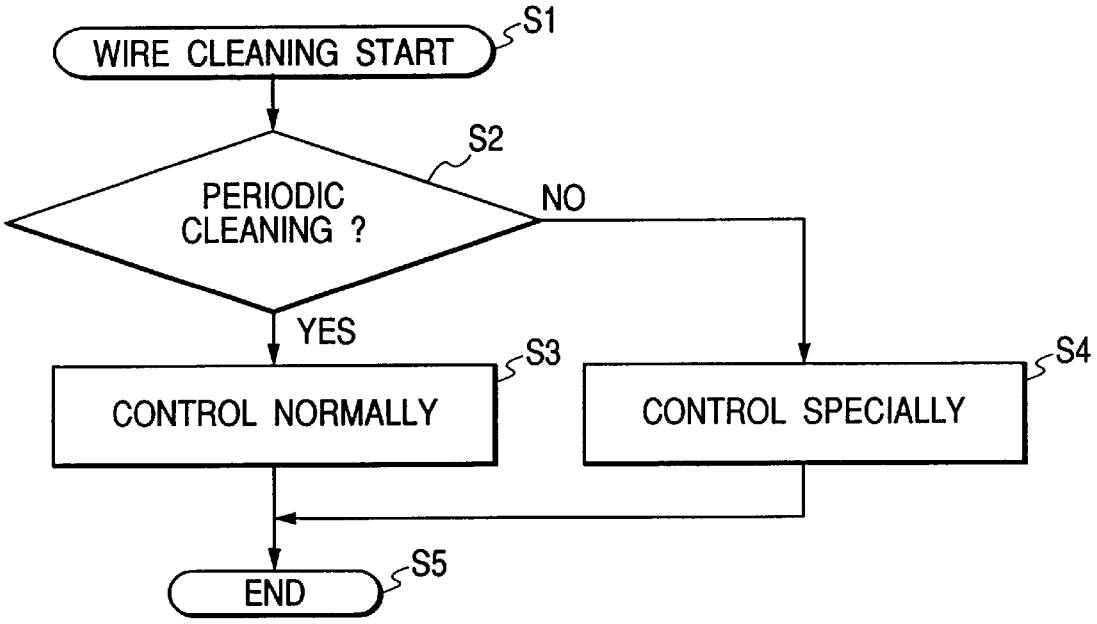
FIG. 4 is a flowchart which illustrates the cleaning control of the charging means.

Now, the description will be made of the image forming apparatus in accordance with a first embodiment of the present invention in conjunction with the accompanying drawings. FIG. 1 shows the entire structure of the image forming apparatus in accordance with the first embodiment of the present invention. FIG. 2 is a plan view which shows the charging means to which the present invention is applicable. FIG. 3 is a cross-sectional view taken along line 3—3 in FIG. 2. FIG. 4 is a flowchart which illustrates the cleaning control of the charging means. FIG. 5 is a table which shows the results of experiments.

At first, in conjunction with FIG. 1, the description will be briefly made of the entire structure of the image forming apparatus. In the image forming apparatus A shown in FIG. 1, each one of the sheet materials P stacked on the sheet feed tray 1 is separately fed by a feed roller 2. Further, the sheet is conveyed to the image recording unit by use of a pair of resist rollers 3 which serve as sheet conveying means.

There is arranged a scanner unit 4 in the upper part of the image forming apparatus A to irradiate beams in accordance with image information. Here, through a prism 4*a*, the beams are irradiated onto the process cartridge 5 which serves as recording means. The process cartridge 5 comprises a photosensitive drum 6 serving as the image carrier;

a corona charger 7 serving as the charging means which will be described later; a developer 8 which develops toner on the photosensitive drum 6; and a cleaner 9 which removes toner remainders from the photosensitive drum 6, among some others. Also, a transfer roller 10 is biased to the photosensitive drum 6.

After being charged uniformly on the surface by use of the corona charger 7, the photosensitive drum 6 forms the electrostatic latent images by means of the beams irradiated by the scanner unit 4. The electrostatic latent images thus produced are developed by toner supplied from the developer 8, hence producing the toner images. Here, the pair of the resist rollers 3 are driven in synchronism with the rotation of the photosensitive drum 6 to convey the sheet material P to the nip between the photosensitive drum 6 and the transfer roller 10.

The sheet material P having the toner images thus transferred to it is further conveyed to a fixer 11 to fix the toner images by the application of heat and pressure. After that, the sheet is exhausted by an exhaust roller 12 to an exhaust tray 13 where it is stacked.

The corona charger 7 serving as charging means is arranged to face the photosensitive drum 6. As shown in FIG. 2, this charger is provided with two charging wires 14. Each one end of the charging wires 14 is connected with the electrode 15 having conductivity, and the other end of them is connected with the electrode 16 through a spring 17, respectively, so that each of them is tensioned. The electrodes 15 and 16 are insulated electrically from the shield plate 18 by means of the insulating blocks 18*a* and 18*b*. Here, when a high-tension voltage is applied to the electrodes 16, the charging wires 14 generate corona discharge to cause the surface of the photosensitive drum 6 to be charged.

The charging wires 14 are provided with cleaners 19 which serve as cleaning means. Each of the cleaners 19 pinches each of the charging wires 14 by use of a pair of cleaning pads 20. Then, as shown in FIG. 3, the structure is arranged to make each of them slidably movable along the wire by use of a moving member 21. The moving member 21 engages with a screw 22. With the screw 22 which is rotatively driven by a driving source (not shown), cleaning is performed with the movement of the moving member 21.

Now, in conjunction with FIG. 4, the operation of cleaning means will be described. When wire cleaning signal is received, cleaning is started (S1) to clean the charging wires 14 at least in the maximum width of the image formation area.

Here, it is determined whether or not the current cleaning is the one performed periodically (S2). If it is found to be the usual one (S3), the cleaning pads 20 are allowed to reciprocate only once per wire cleaning signal. In this respect, the periodic cleaning means the cleaning which should be performed immediately after the electric-supply source is turned on every day, and also, performed per 1,000 sheets of image formation. The periodic cleaning is performed automatically.

Also, for cleaning other than the periodic one, the number of reciprocation is modified. The cleaning pads 20 are allowed to reciprocate five times to slide on the charging wires. This specific cleaning is performed when depressing a switch for use of a service personnel (not shown). Mostly, the service personnel operates it after he has replaced wires.

Hereunder, the detailed description will be made of the reasons why the pad reciprocation is made five times. Here, for the charging wires 14, the oxidized tungsten wires are used after oxidizing the surface thereof, while the cleaning pads 20 are prepared each in such a manner that #1000 alumina grains are fixed on the surface of a rubber sponge by the application of epoxy adhesive. With this combination, no image unevenness takes place as far as charging wires are kept in condition the same as before any cleaning is performed. With just one reciprocation of the cleaning pads, image unevenness may be brought about in some cases. However, an image unevenness of the kind tends to be eliminated if the cleaning reciprocation is repeated several times. Then, it may be possible to eliminate the image unevenness completely only with five times of reciprocation.

Here, therefore, the researches are made to find the causes that may create such image unevenness. As a result, it is ascertained that the oxidized film on the surface of each wire is partly peeled off when slidably rubbed by the cleaning pads having a strong abrasive force. Then, such film once peeled off is allowed to adhere to the wire again, thus causing discharges to be made unevenly with the resultant image unevenness.

Now, however, if the wire cleaning is repeated so that those portions that may easily be peeled off are removed, the oxidized film is no longer subjected to further peeling off. Thus, if only the wire cleaning should be reciprocated five times when the wires are replaced, it becomes possible to prevent the creation of image unevenness.

Also, for the periodic cleaning since then, no image unevenness is encountered even with only one reciprocal cleaning each time, because all the portion where the oxidized film tends to be peeled off has been already removed. Further, as to the stains of the charging wires 14, which may result from the repeated use thereof, it is possible to remove them by the periodic cleaning of the cleaning pads having a strong abrasive force. No image unevenness takes place even after the image formation has been made on 300,000 sheets.

FIG. 5 is a table which shows the conditions of the image unevenness that may be produced by the conventional image forming apparatus and by the apparatus of the present invention. In FIG. 5, the reference mark × indicates the creation of image unevenness. The reference mark ○ indicates no creation of image unevenness. As to the kinds of wires, the partially oxidized tungsten wire means the one which is partially oxidized by the natural oxidation; the gold-plated wire means the one which is formed by applying gold plating to the tungsten wire; and the oxidized tungsten wire means the one which is formed by oxidizing the tungsten wire as described above.

Also, the pad whose abrasive force is weaker means the one which is formed by fixing #6000 SiC grains on the surface of the rubber sponge by the application of epoxy adhesive. The pad whose abrasive force is stronger means the one which is formed by fixing #1000 alumina grains by the application of epoxy adhesive as in the embodiment of the present invention. Here, for the conventional example, the wire cleaning is performed only by one reciprocation which is in the mode of the periodic cleaning.

Also, the item "after wire exchange" subsequent to the wire replacement shown in the column for the used numbers of sheets indicates the situation immediately after the wire cleaning that has been performed subsequent to the replacement of wires with new ones. The item "after 100,000 sheets" indicates the situation after the repetition of image formation on the corresponding numbers of A-4 sized sheets.

As clear from FIG. 5, all the conventional combinations have produced image unevenness both in the cases of "after wire replacement" and "subsequent to the image formation on 100,000 sheets". With the application of the present invention, there has been no image unevenness irrespective of the kinds of wires used. There is no image unevenness after the wire replacement and after the image formation on 100,000 sheets, either. Further, although not shown in FIG. 5, no image unevenness has taken place even after the image formation on 300,000 sheets.

(Second Embodiment)

In accordance with the first embodiment, the structure is arranged so that the special control is executable, which requires more numbers of reciprocation after the replacement of wires by a service personnel who turns on a specific switch. However, the present invention is not necessarily limited to such arrangement of the structure. It may be possible to install detection means on the image forming apparatus to detect the attachment and detachment of charging means. Then, the structure may be arranged so that a special control of the kind is executed when the charging means is installed again after it has been removed. For such detection means, the necessary arrangement is made easily by the provision of a contact switch, such as a microswitch, in the position that faces the charging means of an image forming apparatus, for example.

With the structure thus formed in accordance with the present embodiment, the special control is made executable without depending on the work of a service personnel. This arrangement may also produce a favorable effect that prevents the image unevenness reliably. Also, there is no drawback that may be encountered even when the charging means is attached or detached without replacing wires, because with this arrangement, the number of reciprocation is only increased to five times for the one as in the periodic cleaning.

(Third Embodiment)

For the first and second embodiments described above, the description has been made of the case where the oxidized tungsten wires are used as the charging wires 14. The present invention, however, is not limited thereto. It may be possible to use tungsten wires, gold-plated wires, or the like.

When the wires other than the oxidized tungsten wires are used, it may be possible to define the cleaning conditions in accordance with the properties of each of such wires, not necessarily confined to the structure of the above embodiments, including the number of cleaning, the materials of the cleaning pads, and the like. For example, since the tungsten wires are easier to be naturally oxidized, it is required to adopt a higher abrasive force at the initial stage in order to remove the oxidized portions. Therefore, to enhance the cleaning capability in the earlier stage, it is desirable to use the cleaning pads having the higher abrasive force or to increase the number of cleaning.

Although the present invention has been described with reference to the specific embodiments, it is not meant to be construed in a limiting sense. Various modifications of the disclosed embodiments, as well as other embodiments of the invention, will become apparent with reference to the description of the invention. It is therefore contemplated that the appended claims will cover any modification as fall within the true scope of the invention.

What is claimed is:

1. An image forming apparatus comprising;

an image bearing member;

discharging wire for discharging electricity to said image bearing member;

frictionally sliding means for reciprocating while frictionally sliding along the discharging wire; and switching means for switching the numbers of reciprocation of said frictionally sliding means wherein a first number of reciprocations is used to clean the discharge wire in response to a cleaning signal and a second number of reciprocation is used to clean the discharge wire following a replacement of the discharge wire.

2. An image forming apparatus to claim 1, wherein said switching means selects a smaller number of reciprocation when the discharging wires are cleaned, and selects a larger number of reciprocation when the discharging wires are replaced.

3. An image forming apparatus according to claim 2, wherein the smaller number of reciprocation is one time.

4. An image forming apparatus according to claim 2, wherein cleaning by the smaller number of reciprocation is performed after the power-supply of the apparatus is turned on.

5. An image forming apparatus according to claim 2, wherein the cleaning by the smaller number of reciprocation is performed at each time the number of image formation arrives at a predetermined number.

6. An image forming apparatus according to claim 1, further comprising a switch for changing the numbers, wherein, when the switch is turned on, said switching means selects the larger cleaning number.

7. An image forming apparatus according to claim 1, wherein the discharging wires are tungsten wires having its surface oxidized.

8. An image forming apparatus according to claim 1, wherein said frictionally sliding means are pads having alumina grains adhesively fixed thereon.

9. An image forming apparatus according to claim 1, wherein said discharging wires are provided for an electrostatic charger for charging said image bearing member substantially uniformly.

10. An image forming apparatus according to claim 9, wherein said image bearing member includes a photosensitive layer, and said apparatus further comprises exposure means for forming an electrostatic image by exposing said image bearing member charged by the charger.

* * * * *

UNITED STATES PATENT AND TRADEMARK OFFICE

CERTIFICATE OF CORRECTION

PATENT NO. : 6,163,664
DATED : December 19, 2000
INVENTOR(S) : Nobuhiro Hayashi

It is certified that error appears in the above-identified patent and that said Letters Patent is hereby corrected as shown below:

Title page,
Under item [56] References Cited, Foreign Patent Documents, insert
-- 3-15616 2/1991 Japan
8-305135 11/1996 Japan --.

Column 1,
Line 17, "used" should read -- use --;
Line 55, "entirely, then," should read -- entirely. Then, --.

Column 2,
Line 13, "invention" should read -- invention to provide --.

Column 4,
Line 4, "far" should read -- long --;
Line 5, "condition the same" should read -- the same condition --;
Line 30, "been already" should read -- already been --.

Column 5,
Line 12, "more" should read -- higher -- and "reciprocation" should read -- reciprocations --;
Line 45, "cleaning," should read -- cleanings, --;
Line 52, "cleaning." should read -- cleanings. --.

Column 6,
Line 4, "modification" should read -- modifications --.

Signed and Sealed this

Eleventh Day of September, 2001

*Attest:*

Nicholas P. Godici

*Attesting Officer*

NICHOLAS P. GODICI
*Acting Director of the United States Patent and Trademark Office*